US012110909B2

(12) United States Patent
Watanabe et al.

(10) Patent No.: US 12,110,909 B2
(45) Date of Patent: Oct. 8, 2024

(54) VERTICAL MULTI-STAGE PUMP

(71) Applicant: EBARA CORPORATION, Tokyo (JP)

(72) Inventors: Masaki Watanabe, Tokyo (JP); Hiroyuki Kawasaki, Tokyo (JP); Shuyu Hsu, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/762,437

(22) PCT Filed: Sep. 25, 2020

(86) PCT No.: PCT/JP2020/036389

§ 371 (c)(1),
(2) Date: Mar. 22, 2022

(87) PCT Pub. No.: WO2021/060504

PCT Pub. Date: Apr. 1, 2021

(65) Prior Publication Data

US 2022/0333615 A1 Oct. 20, 2022

(30) Foreign Application Priority Data

Sep. 26, 2019 (JP) ..... 2019-175166
Sep. 26, 2019 (JP) ..... 2019-175846

(51) Int. Cl.
*F04D 1/08* (2006.01)
*F04D 29/28* (2006.01)
(Continued)

(52) U.S. Cl.
CPC ..... *F04D 29/661* (2013.01); *F04D 1/08* (2013.01); *F04D 29/28* (2013.01); *F04D 29/441* (2013.01)

(58) Field of Classification Search
CPC ..... F04D 1/08; F04D 17/122
See application file for complete search history.

(56) References Cited

U.S. PATENT DOCUMENTS 2,678,606 A * 5/1954 Watson ..... F04D 1/06 415/108
4,828,457 A * 5/1989 Bauer ..... F04D 29/448 415/182.1

(Continued)

FOREIGN PATENT DOCUMENTS

CN 102477991 A 5/2012
CN 104728122 A 6/2015

(Continued)

OTHER PUBLICATIONS

International Search Report issued in Patent Application No. PCT/JP2020/036389 dated Dec. 15, 2020.

*Primary Examiner* — Kayla Mccaffrey
(74) *Attorney, Agent, or Firm* — PEARNE & GORDON LLP

(57) ABSTRACT

A vertical multi-stage pump includes a rotation shaft extending in a vertical direction, a plurality of impellers fixed to the rotation shaft, a multi-stage pump chamber accommodating the plurality of impellers and comprising a suction port for a first-stage impeller at a lower end, a lower casing comprising a suction nozzle extending in a horizontal direction and forming a communication space communicating the suction nozzle and the suction port, and an inner cylinder member interposed between the multi-stage pump chamber and a lower casing and expanding the communication space in a vertical direction.

11 Claims, 16 Drawing Sheets

(51) Int. Cl.
*F04D 29/44* (2006.01)
*F04D 29/66* (2006.01)

(56) References Cited

U.S. PATENT DOCUMENTS

| | | | | |
|---|---|---|---|---|
| 5,112,190 | A | 5/1992 | Kajiwara et al. | |
| 5,309,946 | A * | 5/1994 | Ligneul | F15D 1/02 366/337 |
| 5,888,053 | A * | 3/1999 | Kobayashi | F04D 29/445 417/244 |
| 8,267,644 | B2 * | 9/2012 | Nishida | F04D 17/122 415/199.1 |
| 10,578,110 | B2 * | 3/2020 | Husveg | F04D 1/10 |

FOREIGN PATENT DOCUMENTS

| | | | |
|---|---|---|---|
| CN | 110230600 | A | 9/2019 |
| EP | 0726397 | A1 | 8/1996 |
| EP | 1122445 | A1 | 8/2001 |
| JP | 2005-146981 | A | 6/2005 |
| JP | 2006-200489 | A | 8/2006 |
| JP | 2009-191730 | A | 8/2009 |
| JP | 2009-222003 | A | 10/2009 |
| JP | 2014-098313 | A | 5/2014 |
| JP | 2017-531757 | A | 10/2017 |
| JP | 2019-056343 | A | 4/2019 |
| JP | 2020002908 | A * | 1/2020 |
| KR | 10-1607502 | B1 | 3/2016 |
| WO | 2006/008843 | A1 | 1/2006 |
| WO | 2016/060221 | A1 | 4/2016 |
| WO | 2019/058669 | A1 | 3/2019 |

* cited by examiner

VERTICAL MULTI-STAGE PUMP

CROSS-REFERENCE TO RELATED APPLICATIONS

This application is a U.S. national stage application of the PCT International Application No. PCT/JP2020/036389 filed on Sep. 25, 2020, which claims the benefit of foreign priority of Japanese Patent Application No. 2019-175166 filed on Sep. 26, 2019 and Japanese Patent Application No. 2019-175846 filed on Sep. 26, 2019, the contents all of which are incorporated herein by reference.

TECHNICAL FIELD

The present invention relates to a vertical multi-stage pump.

The present application claims priority under Japanese Patent Application No. 2019-175846 filed in Japan on Sep. 26, 2019, and Japanese Patent Application No. 2019-175166 filed in Japan on Sep. 26, 2019, the contents of which are incorporated herein by reference.

BACKGROUND ART

FIG. 1 of Patent Document 1 described below discloses a vertical multi-stage pump that is incorporated and used in the middle of piping of a fluid facility. The vertical multi-stage pump includes a rotation shaft extending in the vertical direction, a plurality of impellers fixed to the rotation shaft, a multi-stage pump chamber accommodating the plurality of impellers and provided with a suction port for the first-stage impeller at a lower end, and a lower casing including a suction nozzle extending in the horizontal direction and forming a communication space for communicating the suction nozzle and the suction port.

PRIOR ART DOCUMENTS

Patent Documents

[Patent Document 1] Published Japanese Translation No. 2017-531757 of the PCT International Publication

DISCLOSURE OF INVENTION

Problems to be Solved by the Invention

In such a vertical multi-stage pump, the fluid sucked horizontally from the suction nozzle changes its flow path by substantially 90 degrees toward the suction port in the communication space of the lower casing, and the fluid flows into the impeller immediately after changing flow path. A lot of swirling vortices occur in the fluid when the flow path is changed. These swirling vortices obstruct the flow of fluid, and the suction performance of the pump deteriorates due to the occurrence of fluid loss. Therefore, when the fluid is hot water or used in highlands, there is a possibility that fluid suction becomes difficult.

The present invention has been made in view of the issues described above, and an object of the present invention is to provide a vertical multi-stage pump capable of suppressing deterioration of the suction performance of the pump.

Means for Solving the Problems

A vertical multi-stage pump according to an aspect of the present invention includes a rotation shaft extending in a vertical direction, a plurality of impellers fixed to the rotation shaft, a multi-stage pump chamber accommodating the plurality of impellers and comprising a suction port for a first-stage impeller at a lower end, a lower casing comprising a suction nozzle extending in a horizontal direction and forming a communication space communicating the suction nozzle and the suction port, and an inner cylinder member interposed between the multi-stage pump chamber and a lower casing and expanding the communication space in a vertical direction.

The vertical multi-stage pump described above may include an annular wall protruding toward inside of the inner cylinder member more than a peripheral wall of the inner cylinder member.

In the vertical multi-stage pump described above, a center of an inner edge of the annular wall may be eccentric with respect to a center of the suction port.

The vertical multi-stage pump described above may include a cylindrical guide extending in a vertical direction from a lower end opening of the inner cylinder member to the suction port.

The vertical multi-stage pump described above may include a rectification grid provided inside the cylindrical guide.

In the vertical multi-stage pump described above, a center of the cylindrical guide is eccentric with respect to a center of the suction port.

The vertical multi-stage pump described above may include, in the communication space of the lower casing, a first swivel prevention plate extending in a radial direction toward a central axis of the rotation shaft, and inside the inner cylinder member, a second swivel prevention plate extending in a radial direction toward a central axis of the rotation shaft.

A vertical multi-stage pump according to an aspect of the present invention includes a rotation shaft extending in a vertical direction, a plurality of impellers fixed to the rotation shaft, a multi-stage pump chamber accommodating the plurality of impellers and comprising a first suction port for a first-stage impeller at a lower end, and a lower casing comprising a suction nozzle extending in a horizontal direction and forming a communication space communicating the suction nozzle and the first suction port, in which the first suction port is formed larger than a second suction port of a second- or subsequent-stage impeller.

The vertical multi-stage pump described above may include a swivel prevention plate extending radially toward a central axis of the rotating shaft in the communicating space.

The vertical multi-stage pump described above may include a conical raised portion centered on the rotation shaft on a bottom surface of the communication space.

The vertical multi-stage pump described above may include a guide portion arranged on an extension line of the suction nozzle and curved from a horizontal direction to an upward direction in a vertical direction in the communication space.

In the vertical multi-stage pump described above, an outlet diameter of the suction nozzle may be larger than an inlet diameter of the suction nozzle.

Effects of the Invention

According to the aspects of the present invention described above, deterioration of the suction performance of the pump can be suppressed.

EMBODIMENTS FOR CARRYING OUT THE INVENTION

Hereinafter, embodiments of the present invention will be described with reference to the drawings.

First Embodiment

Figure 1:
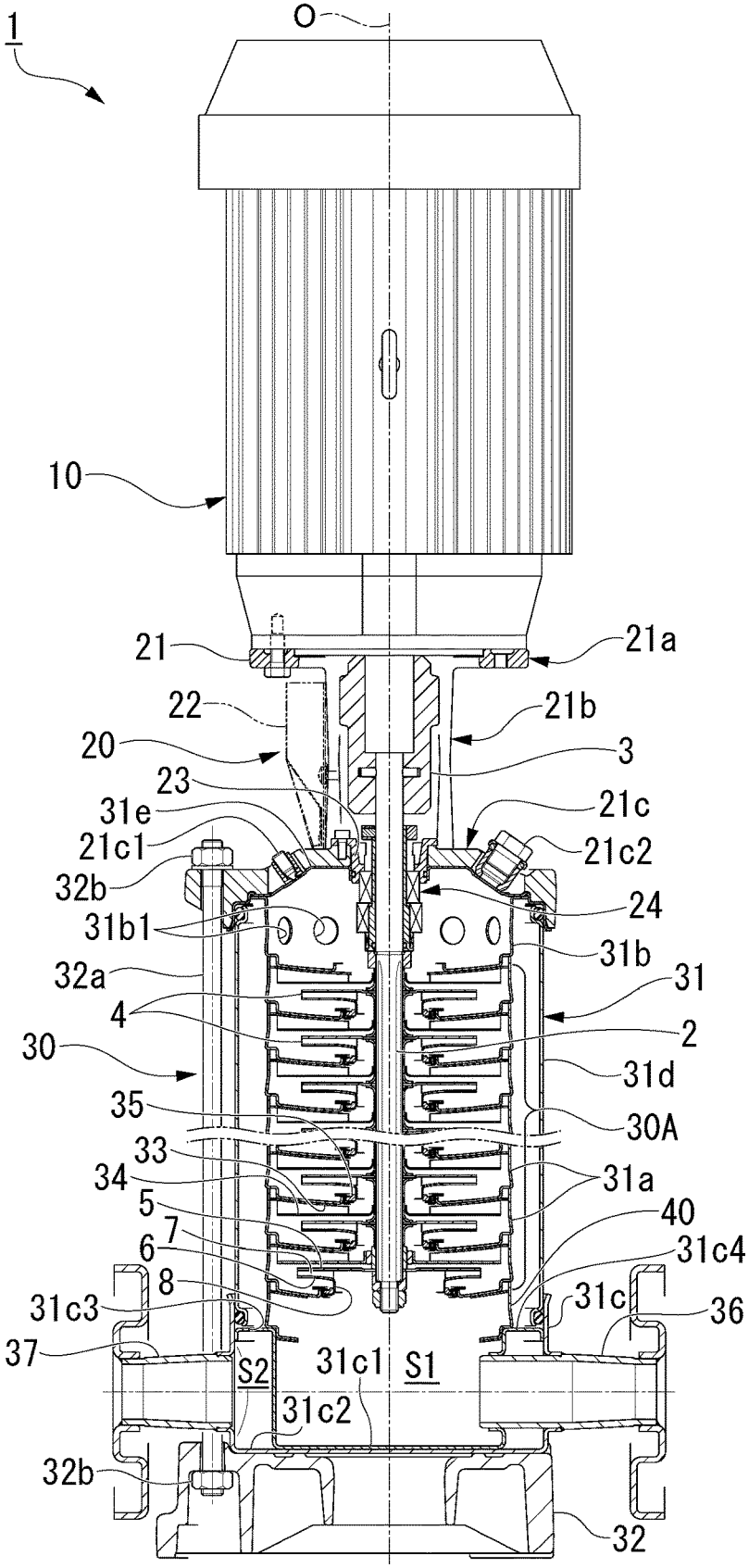
FIG. 1 is a cross-sectional view of the overall configuration of the vertical multi-stage pump according to a first embodiment.

FIG. 1 is a cross-sectional view of the overall configuration of a vertical multi-stage pump 1 according to the first embodiment.

As shown in FIG. 1, the vertical multi-stage pump 1 includes a motor 10, a coupling portion 20, and a pump portion 30. The pump portion 30 includes a rotation shaft 2 extending in the vertical direction. In the following descriptions, a direction in which the central axis O of the rotation shaft 2 extends (i.e., vertical direction) is referred to as an axial direction, a direction orthogonal to the central axis O is referred to as a radial direction, and a direction orbiting around the central axis O is referred to as a circumferential direction.

The motor 10 is arranged above the pump portion 30 and is connected to the rotation shaft 2 via a coupling 3. The motor 10 is supported by the pump portion 30 via a bracket 21 of the coupling portion 20. The motor 10 rotates at a predetermined rotation speed. The motor 10 may be configured to be capable of low-speed rotation (shifting) by using, for example, an inverter even when a commercial power source is used, regardless of the predetermined rotation speed.

The coupling portion 20 includes the bracket 21 that surrounds the coupling 3, and a guard member 22 that is attached to the bracket 21 and covers the coupling 3. The bracket 21 includes a pedestal portion 21*a* to which the motor 10 is attached, a leg portion 21*b* that supports the pedestal portion 21*a*, and a lid portion 21*c* on which the leg portion 21*b* stands. The pedestal portion 21*a* is formed in an annular shape centered on the central axis O.

The leg portions 21*b* are connected to the lower surface of the pedestal portion 21*a* at intervals in the circumferential direction. The coupling 3 is arranged between the leg portions 21*b*. The guard member 22 is attached to the leg portion 21*b* so as to close the space between the leg portions 21*b*. The lid portion 21*c* is connected to the lower end of the leg portion 21*b* and covers the upper portion of the pump portion 30. The lid portion 21*c* is formed in a substantially topped cylinder shape centered on the central axis O, and an insertion hole 23 through which the rotation shaft 2 is inserted is formed at the center thereof.

A mechanical seal 24 is arranged in the insertion hole 23. The mechanical seal 24 vertically seals the gap between the rotation shaft 2 and the insertion hole 23, and prevents the fluid from leaking from the pump portion 30 to the outside through the insertion hole 23. A priming faucet 21*c*1 and an air venting faucet 21*c*2 are arranged radially outside the insertion hole 23 of the lid portion 21*c*. A plurality of impellers 4 are fixed to the rotation shaft 2 at intervals in the axial direction inside the pump portion 30.

The impeller 4 includes a main plate 5, a side plate 6, and a plurality of blades 7. The main plate 5 is formed in a disk shape centered on the central axis O, and is fixed to the rotation shaft 2. The side plate 6 is formed in an annular shape coaxial with the main plate 5, and is arranged with a gap from the main plate 5. The main plate 5 and the side plate 6 are connected via the plurality of blades 7. The space surrounded by the main plate 5, the side plate 6, and the plurality of blades 7 is a flow path that guides the fluid in the radial direction. The side plate 6 forms a suction port 8 of the impeller 4.

The pump portion 30 includes a tubular casing 31 that accommodates the plurality of impellers 4. The casing 31 internally forms a multi-stage pump chamber 30A that boosts the fluid by the impeller 4. The casing 31 is arranged outside an intermediate casing 31*a*, an upper casing 31*b* arranged at the upper portion of the intermediate casing 31*a*, a lower casing 31*c* arranged at the lower portion of the intermediate casing 31*a*, and an outer casing 31*d* arranged outside the intermediate casing 31*a* and the upper casing 31*b*.

The intermediate casing 31*a* is formed by press-molding a steel plate or the like into a bottomed cylindrical shape, and an opening through which the rotation shaft 2 is inserted is formed in the center of the bottom portion of the intermediate casing 31*a*. The intermediate casings 31*a* are stacked in multiple stages according to the number of impellers 4. A suction plate 33 is attached to the lower surface of the bottom of the intermediate casing 31*a* by welding. In addition, a return blade 34 is attached to the lower surface of the suction plate 33 by welding. A liner ring 35 for preventing fluid leakage from the periphery of the suction port 8 of the impeller 4 is attached to the inner wall of the bottom opening of the intermediate casing 31*a*.

The upper casing 31*b* is formed in the same bottomed tubular shape as the intermediate casing 31*a*, and is stacked on the uppermost stage of the intermediate casing 31*a*. A plurality of communication holes 31*b*1 are formed on the peripheral wall of the upper casing 31*b*. The outer casing 31*d* is formed in a cylindrical shape that surrounds the radial outer side of the intermediate casing 31*a* and the upper casing 31*b*. The outer casing 31*d* forms an annular flow path communicating with the communication hole 31*b*1 on the radial outer side of the intermediate casing 31*a* and the upper casing 31*b*. The upper portions of the upper casing 31*b* and the outer casing 31*d* are covered with a casing cover 31*e* arranged on the lower surface of the lid portion 21*c*.

The lower casing 31*c* forms a communication space S1 communicating with the suction port 8 at the lower end of the multi-stage pump chamber 30A, and also forms a communication space (second communication space) S2 communicating with the above-mentioned annular flow path inside the outer casing 31*d*. The lower casing 31*c* includes a first frame 31*c*1 that forms the communication space S1 inside, and a second frame 31*c*2 that surrounds the outside of the first frame 31*c*1 and forms the communication space S2 between the first frame 31*c*1 and the second frame 31*c*2.

The first frame 31*c*1 is formed in a bottomed tubular shape (substantially a dish shape) having a flange portion 31*c*4 in which a communication hole 31*c*3 is formed. The communication hole 31*c*3 penetrates the flange portion 31*c*4 in the axial direction to communicate the above-mentioned annular flow path and the communication space S2. The second frame 31*c*2 is formed in a bottomed cylinder shape that houses the first frame 31*c*1 in a nested manner. By contacting the inner peripheral surface of the second frame 31*c*2 with the outer edge of the flange portion 31*c*4 of the first frame 31*c*1, a gap (communication space S2) is formed between the outer peripheral surface of the first frame 31*c*1 and the inner peripheral surface of the second frame 31*c*2.

The lower casing 31*c* includes a suction nozzle 36 extending in the horizontal direction and a discharge nozzle 37 extending in the horizontal direction as well. The suction nozzle 36 penetrates the peripheral wall of the second frame 31*c*2 and is joined, and also penetrates the peripheral wall of the first frame 31*c*1 and extends to the communication space S1. The discharge nozzle 37 is arranged back-to-back on the same straight line as the suction nozzle 36, and is joined by penetrating the peripheral wall of the second frame 31*c*2, and communicates with the communication space S2 without penetrating the peripheral wall of the first frame 31*c*1.

A pump base 32 is provided at the lower portion of the lower casing 31*c*. The pump base 32 is axially connected to the bracket 21 of the coupling portion 20 by a casing bolt 32*a* and a nut 32*b*. A plurality of casing bolts 32*a* and nuts 32*b* are provided at intervals in the circumferential direction. By tightening the plurality of casing bolts 32*a* and nuts 32*b*, the multi-stage intermediate casing 31*a*, the upper casing 31*b*, the lower casing 31*c*, and the casing cover 31*e* (in addition, an inner cylinder member 40 described later) are sandwiched in the axial direction.

According to the pump portion 30 having the above-described configuration, when the impeller 4 rotates, the fluid is sucked from the suction nozzle 36 into the communication space S1 of the lower casing 31*c*. The fluid sucked into the communication space S1 of the lower casing 31*c* is sucked into the first-stage impeller 4 from the suction port 8 at the lower end of the multi-stage pump chamber 30A and boosted. The fluid discharged from the first-stage impeller 4 is guided to the suction side of the next-stage impeller 4 through the flow path formed by the return blade 34 and the suction plate 33.

The fluid is boosted in multiple stages by the plurality of impellers 4 in such a manner, and then flows into the upper casing 31*b*. The fluid flowing into the upper casing 31*b* descends from the communication hole 31*b*1 through the annular flow path formed on the outside of the upper casing 31*b*, and flows into the communication space S2 through the communication hole 31*c*3. The fluid flowing into the communication space S2 is discharged through the discharge nozzle 37 connected to the lower casing 31*c*. Since it is arranged on the same straight line as the suction nozzle 36, the discharge nozzle 37 can be incorporated in the middle of the piping of fluid equipment such as a factory.

In such a vertical multi-stage pump 1, the fluid is sucked horizontally from the suction nozzle 36, the flow path is changed by substantially 90 degrees toward the suction port 8 in the communication space S1 of the lower casing 31*c*, and the fluid flows into the impeller 4. A lot of swirling vortices are generated in the fluid when the flow path is changed. Hereinafter, a characteristic configuration that suppresses the generation of such a swirling vortex will be described with reference to FIG. 2.

Figure 2:
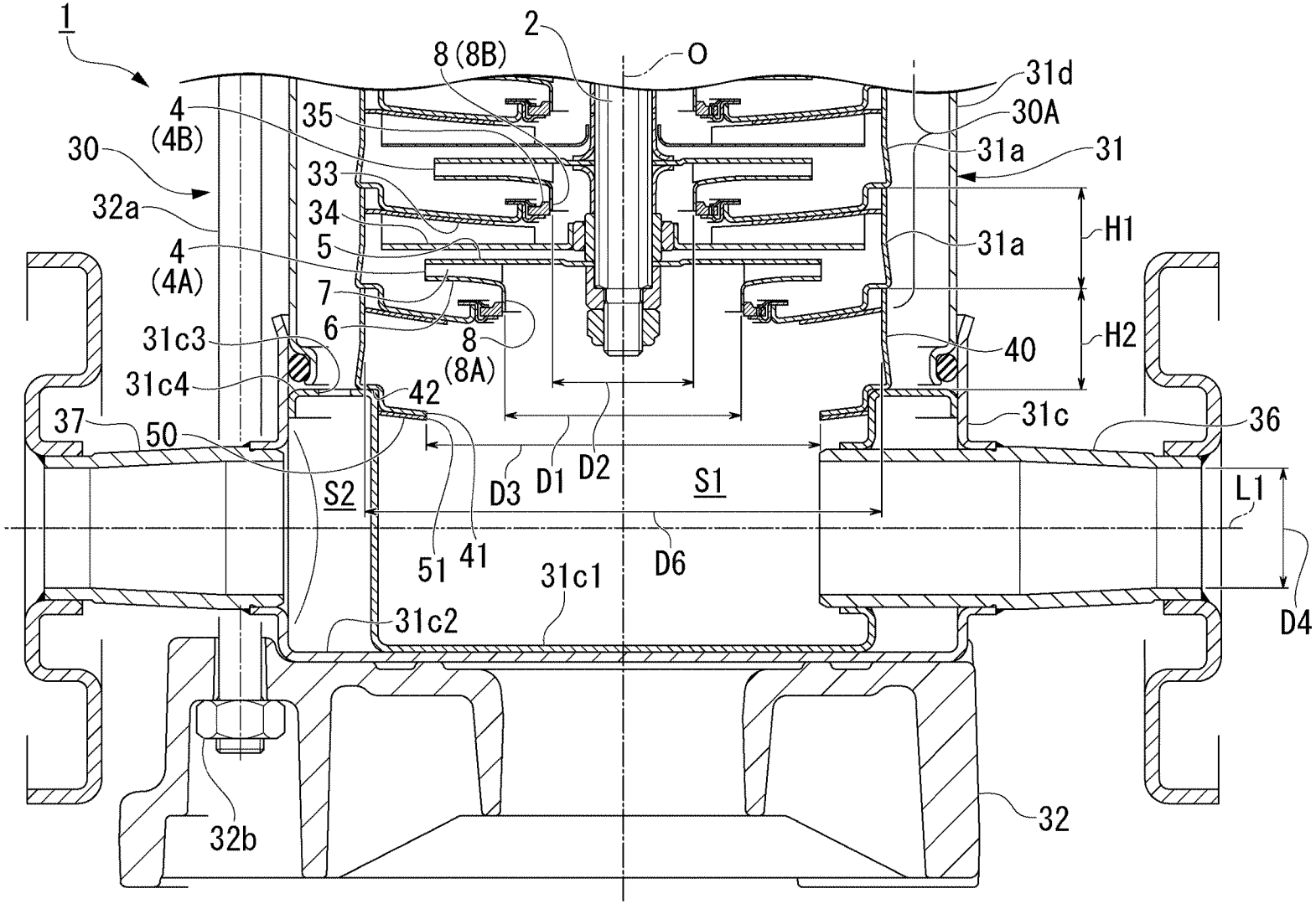
FIG. 2 is a cross-sectional view of the main configuration of the vertical multi-stage pump according to a first embodiment.

FIG. 2 is a cross-sectional view showing a configuration of a main portion of the vertical multi-stage pump 1 according to the first embodiment.

In the vertical multi-stage pump 1, as shown in FIG. 2, a first suction port 8A of a first-stage impeller 4A arranged at the lower end of the multi-stage pump chamber 30A is formed to be larger than the second suction port of a second- or subsequent-impeller 4B provided in the multi-stage pump chamber 30A. That is, the port diameter D1 of the first suction port 8A is larger than a port diameter D2 of a second suction port 8B.

Incidentally, an inlet diameter (pump diameter) D4 of the suction nozzle 36 described above is uniformly determined by the JIS standard or the like depending on the flow rate used. The port diameter D2 of the second suction port 8B of the impeller 4B of the second and subsequent stages is a suction port diameter of a standard product determined by the inlet diameter D4 of the suction nozzle 36. In particular, the port diameter D2 of the second suction port 8B has a size of 1 to 1.5 times the inlet diameter D4 of the suction nozzle 36. The port diameter D1 of the first suction port 8A has a size of 1.5 to 2 times larger than the port diameter D2 of the second suction port 8B.

In addition, as shown in FIG. 2, the vertical multi-stage pump 1 includes the inner cylinder member 40 that is interposed between the above-mentioned multi-stage pump chamber 30A (i.e., intermediate casing 31*a*) and the lower casing 31*c* to expand the communication space S1 in the vertical direction.

Similar to the intermediate casing 31*a*, the inner cylinder member 40 is formed into a bottomed cylinder by press-molding a steel plate or the like. The lowermost stage of the intermediate casing 31*a* is stacked on the inner cylinder member 40. The inner cylinder member 40 has a lower end opening 41 centered on the central axis O formed in the center of the bottom portion. In addition, an in-row portion (step portion) 42 that can be engaged with the inner end edge of the upper end opening of the first frame 31*c*1 of the lower casing 31*c* is formed on the outer side in the radial direction of the lower end opening 41 of the inner cylinder member 40.

A height H2 of the inner cylinder member 40 in the axial direction has a size of 0.5 to 2 times a height H1 of the intermediate casing 31*a*. If the height H2 of the inner cylinder member 40 is the same as the height H1 of the intermediate casing 31*a*, the portions of the intermediate casing 31*a* (without suction plate 33, return blade 34, liner ring 35) are diverted to the inside. The cylinder member 40 can be formed at low cost. A cylinder diameter D6 of the inner cylinder member 40 (inner diameter of the peripheral wall of the inner cylinder member 40) may be the same as the cylinder diameter of the intermediate casing 31*a* in consideration of stacking.

An annular wall 50 protruding toward the inside of the inner cylinder member 40 more than the peripheral wall of the inner cylinder member 40 is attached to the lower surface of the bottom of the inner cylinder member 40 by welding. The annular wall 50 is formed in a donut shape, and an inner end edge 51 thereof is formed around the central axis O. The inner diameter D3 of the annular wall 50 has a size of 1.5 to 3 times that of the suction port diameter of a standard product (second suction port 8B of the impeller 4B) determined by the inlet diameter D4 of the suction nozzle 36 described above.

According to the vertical multi-stage pump 1 having the above-described configuration, it is provided with the rotation shaft 2 extending in the vertical direction, the plurality of impellers 4 fixed to the rotation shaft 2, the multi-stage pump chamber 30A accommodating the plurality of impellers 4 and including the first suction port 8A for a first-stage impeller 4A at a lower end, the lower casing 31*c* including the suction nozzle 36 extending in a horizontal direction and forming the communication space S1 communicating the suction nozzle 36 and the suction port 8, and the inner cylinder member 40 that is interposed between the multi-stage pump chamber 30A and the lower casing 31*c* and expands the communication space S1 in the vertical direction. Thus, deterioration of the suction performance of the pump can be suppressed.

That is, the flow of the fluid from the suction nozzle 36 to the first suction port 8A of the impeller 4A changes substantially 90 degrees from the horizontal direction to the vertical direction, so that a turbulent flow such as a swirling vortex occurs. However, after the change of the 90 degrees, by extending the communication space S1 in the vertical direction by the inner cylinder member 40 and providing a distance, the turbulent flow can be rectified to some extent before flowing into the first suction port 8A of the impeller 4A. Therefore, the swirling vortex flowing into the first suction port 8A of the impeller 4A is reduced, and the suction efficiency of the pump is improved. In addition, by reducing the swirling vortex, wear and deterioration of the flow path portion of the pump can be suppressed, and the life of the pump can be improved.

In addition, in the present embodiment, since the annular wall 50 protrudes toward the inside of the inner cylinder member 40 more than the peripheral wall of the inner cylinder member 40, the turbulent flow generated in the outer peripheral portion of the communication space S1 is rectified. Therefore, the swirling vortex flowing into the first suction port 8A of the impeller 4A is reduced, and the suction efficiency of the pump is further improved.

In addition, according to the vertical multi-stage pump 1 having the above configuration, it is provided with the rotation shaft 2 extending in the vertical direction, the plurality of impellers 4 fixed to the rotation shaft 2, a multi-stage pump chamber 30A accommodating the plurality of impellers 4 and including the first suction port 8A for a first-stage impeller 4 at a lower end, and a lower casing 31*c* including a suction nozzle 36 extending in a horizontal direction and forming a communication space S1 communicating the suction nozzle 36 and the first suction port 8A, and the first suction port 8A is formed to be larger than the second suction port 8B of the impeller 4 of the second- or subsequent-stages provided in the multi-stage pump chamber 30A. Thus, the deterioration of the suction performance of the pump can be suppressed.

That is, the fluid flowing into the communication space S1 from the suction nozzle 36 causes a turbulent flow such as a swirling vortex due to the narrowing of the flow path when entering the suction port 8 of the impeller 4. However, since the port diameter D1 of the first suction port 8A of the first suction of the impeller 4A is formed to be larger than the suction port diameter of a general standard product (port diameter D2 of the second suction port 8B), the change in the flow path diameter can be mitigated. As a result, the flow of the fluid can be brought closer to the steady flow, and the turbulent flow (such as a swirling vortex) flowing into the first suction port 8A of the impeller 4A can be suppressed, so that the suction efficiency of the pump is improved. In addition, by reducing the swirling vortex, wear and deterioration of the flow path portion of the pump can be suppressed, and the life of the pump can be improved.

In the above-mentioned first embodiment, the modification example shown in FIGS. 3 to 5 below can be employed.

Figure 3:
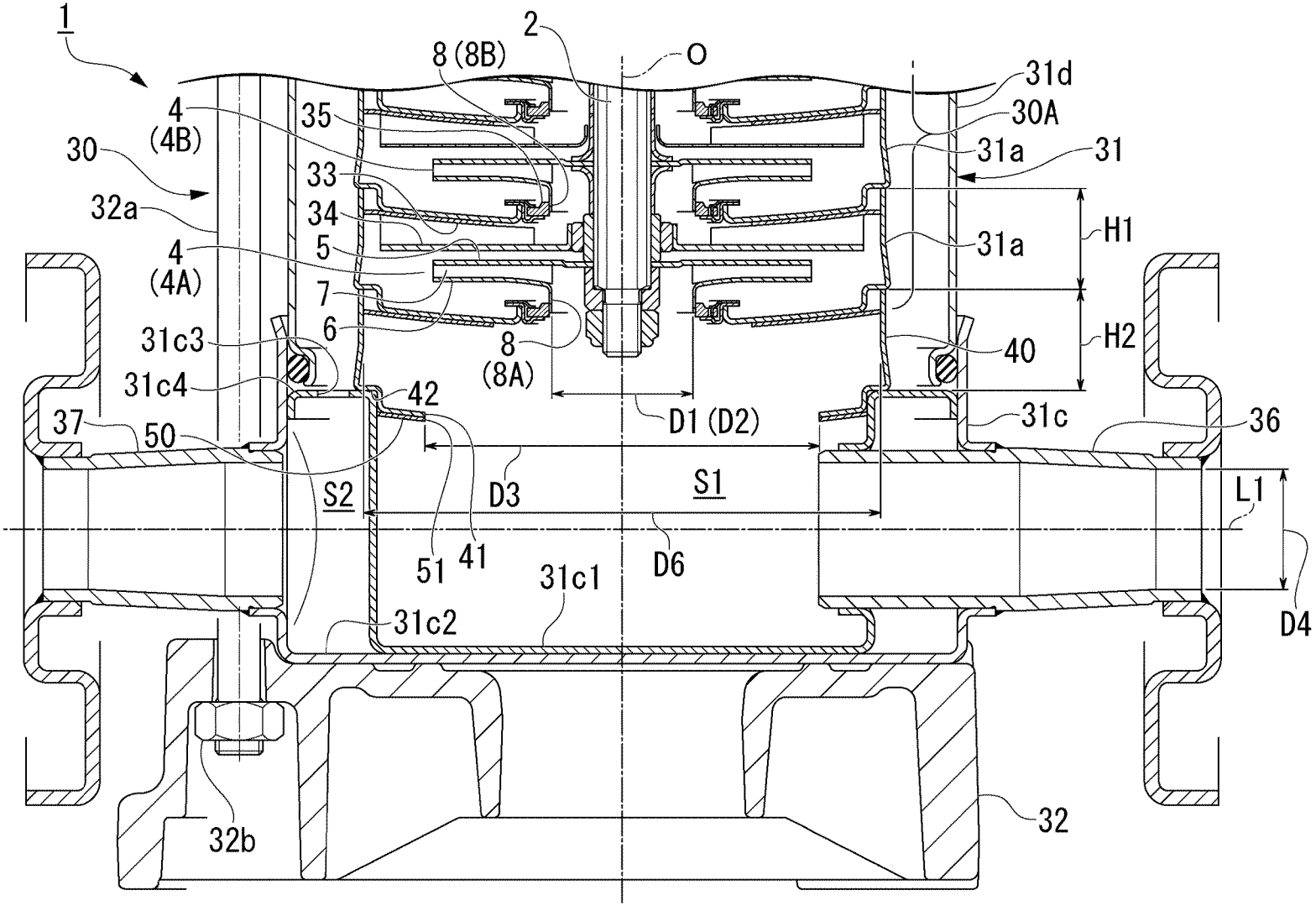
FIG. 3 is a cross-sectional view of the main configuration of the vertical multi-stage pump according to a modification example of a first embodiment.

FIG. 3 is a cross-sectional view showing a configuration of a main portion of the vertical multi-stage pump 1 according to a modification example of the first embodiment.

In the vertical multi-stage pump 1 shown in FIG. 3, the first suction port 8A of the first-stage impeller 4A arranged at the lower end of the multi-stage pump chamber 30A is not formed to be larger than the second suction port 8B of the second- or subsequent-stage impellers 4B provided with the multi-stage pump chamber 30A. That is, the port diameter D1 of the first suction port 8A may be equal to the port diameter D2 (suction port diameter of a standard product) of the second suction port 8B. Even with such a configuration, if the inner cylinder member 40 described above is provided, the communication space 51 can be expanded in the vertical direction to rectify the flow of the fluid and suppress the deterioration of the suction performance of the pump.

Figure 4:
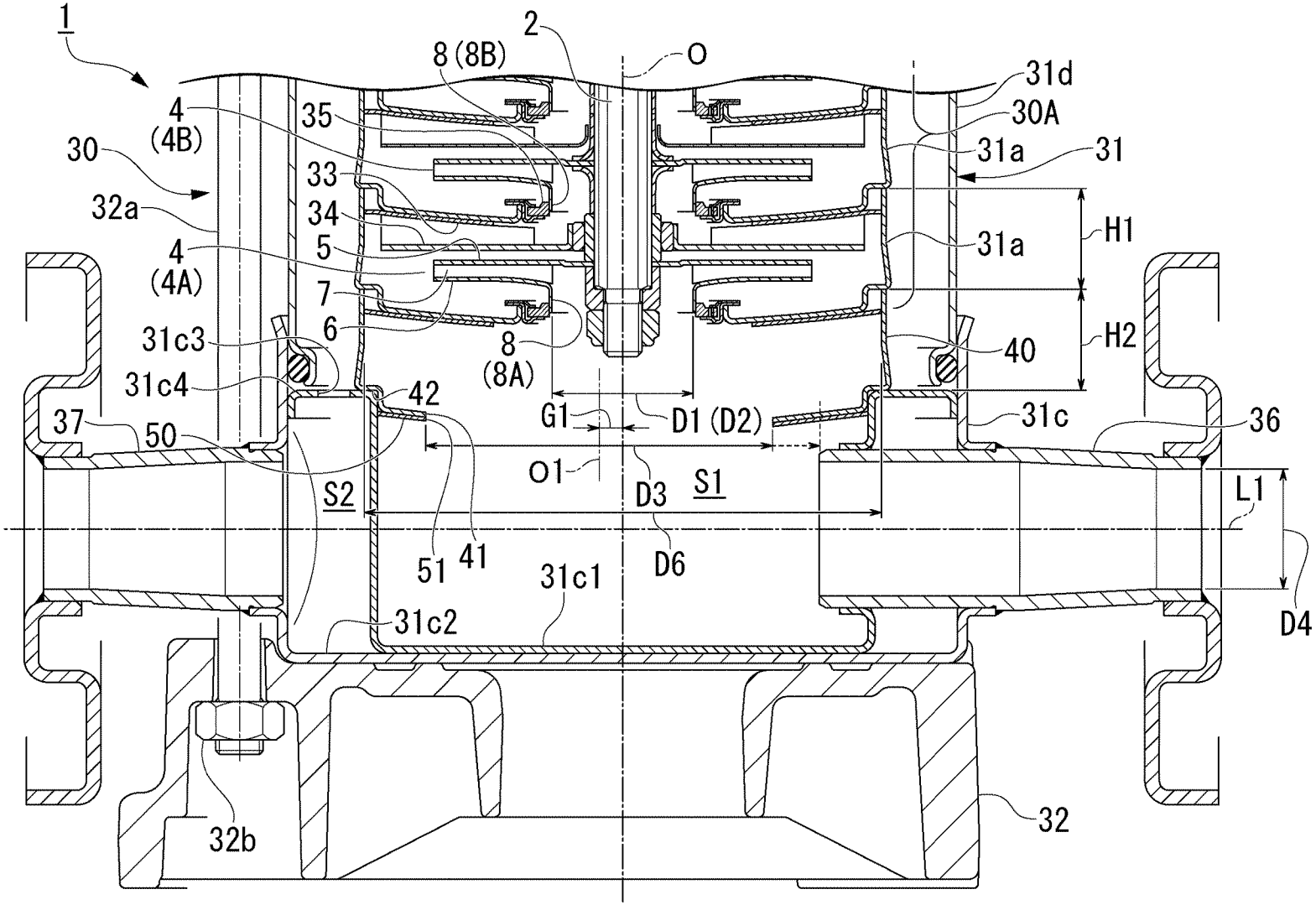
FIG. 4 is a cross-sectional view of the main configuration of the vertical multi-stage pump according to a modification example of a first embodiment.

FIG. 4 is a cross-sectional view showing a configuration of a main portion of the vertical multi-stage pump 1 according to a modification example of the first embodiment.

In the vertical multi-stage pump 1 shown in FIG. 4, a center O1 of the inner end edge 51 of the annular wall 50 is eccentric with respect to the center (central axis O) of the suction port 8 of the impeller 4. The amount of eccentricity G1 in the horizontal direction of the inner end edge 51 of the annular wall 50 with respect to the central axis O is preferably 0.1 mm to 40 mm as an example. The shape of the inner end edge 51 of the annular wall 50 in plan view from the axial direction is not limited to a circle, but may be an ellipse.

According to such a configuration, by shifting the center O1 of the annular wall 50 so that the center (central axis O) of the suction port 8 of the impeller 4 does not match, uniform inflow of the swirling vortex to the inner cylinder member 40 is blocked (i.e., flow is disturbed) that is generated when the fluid flows from the suction nozzle 36 into the lower casing 31*c* and changes its flow path by substantially 90 degrees. Thus, the swirling vortex can be reduced. Due to the reduction of the swirling vortex, the fluid loss is suppressed and the suction performance of the pump is improved as compared with the conventional configuration.

Figure 5:
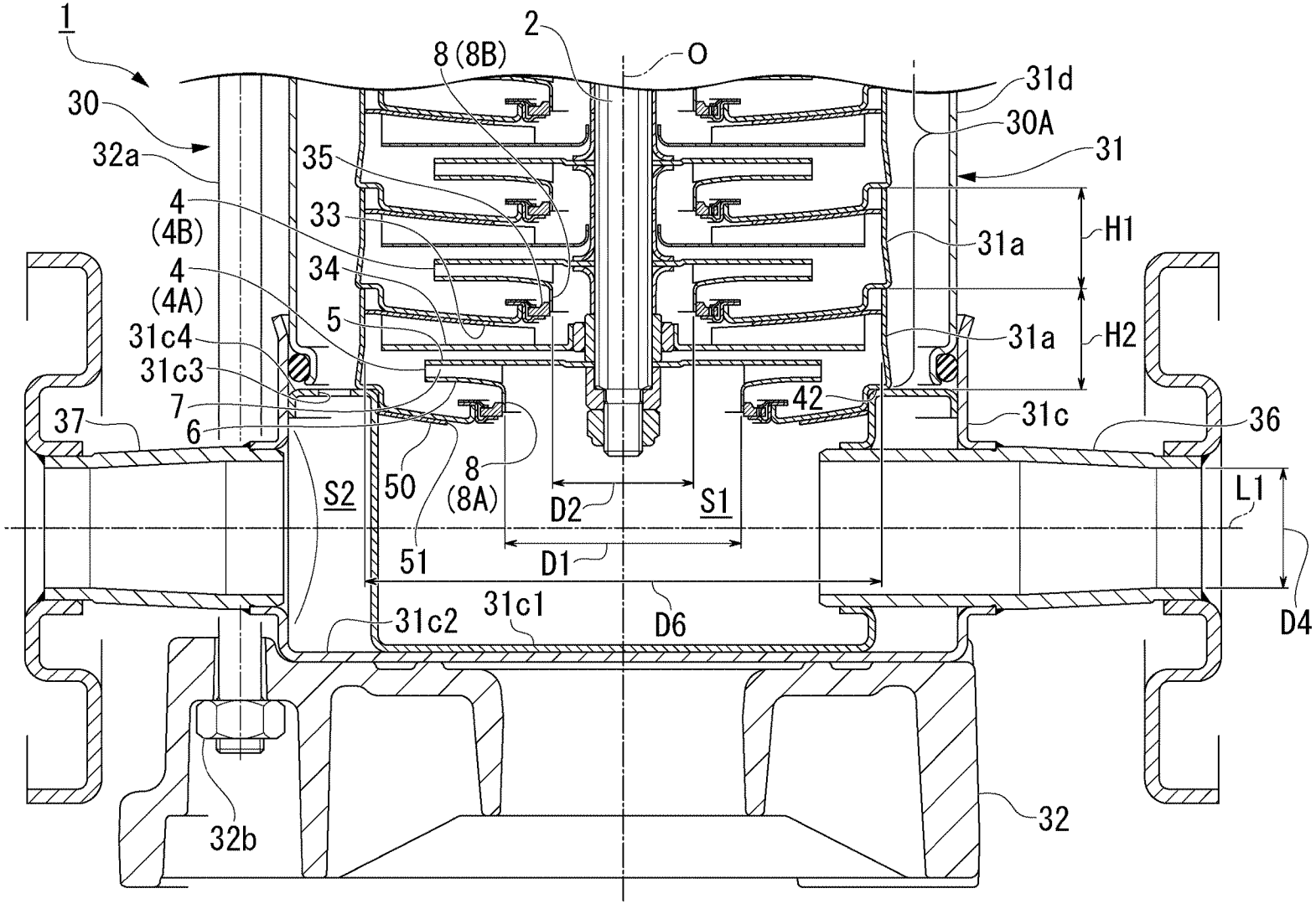
FIG. 5 is a cross-sectional view of the main configuration of the vertical multi-stage pump according to a modification example of a first embodiment.

FIG. 5 is a cross-sectional view showing a configuration of a main portion of the vertical multi-stage pump 1 according to a modification example of the first embodiment.

In the vertical multi-stage pump 1 shown in FIG. 5, the inner cylinder member 40 is not interposed between the multi-stage pump chamber 30A (intermediate casing 31*a*) and the lower casing 31*c*. That is, the intermediate casing 31*a* may be directly stacked on the lower casing 31*c*. Even with such a configuration, if the first suction port 8A of the first-stage impeller 4A arranged at the lower end of the multi-stage pump chamber 30A is formed to be larger than the second suction port 8B of the second- or subsequent-impeller 4B provided in the multi-stage pump chamber 30A, the swirling vortex can be reduced and the deterioration of the suction performance of the pump can be suppressed.

Second Embodiment

Next, the second embodiment of the present invention will be described. In the following description, the same or equivalent configurations as those in the above-described embodiment are designated by the same reference numerals, and the description thereof will be simplified or omitted.

Figure 6:
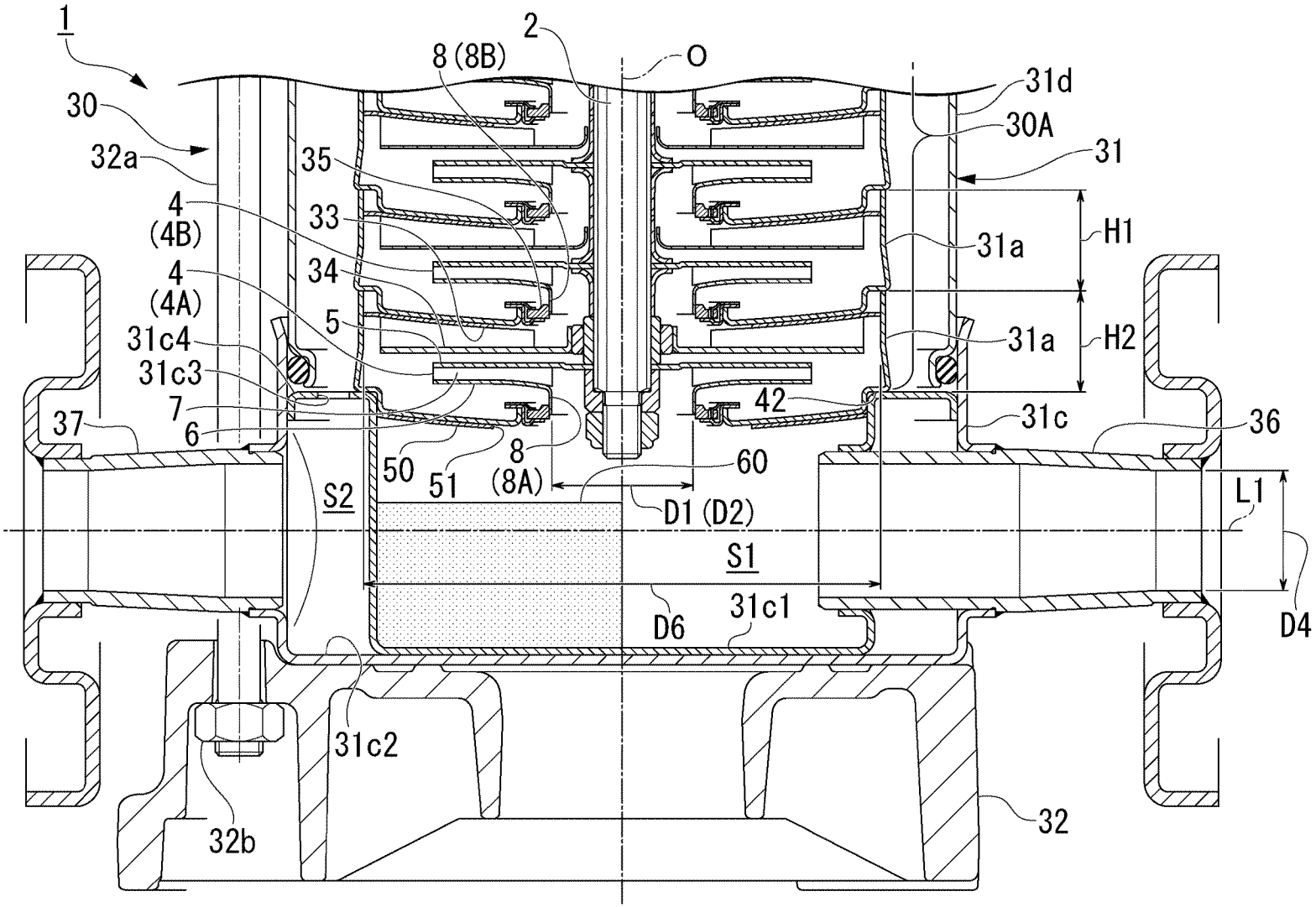
FIG. 6 is a cross-sectional view of the main configuration of the vertical multi-stage pump according to a second embodiment.

FIG. 6 is a cross-sectional view showing a main portion configuration of the vertical multi-stage pump 1 according to the second embodiment.

As shown in FIG. 6, the vertical multi-stage pump 1 of the second embodiment includes a swivel prevention plate 60 extending in the radial direction toward the central axis O of the rotation shaft 2 in the communication space S1, which are different from the above-described embodiment.

As shown in FIG. 6, the swivel prevention plate 60 is formed in a rectangular plate shape, and is arranged on the opposite side of the suction nozzle 36 in the communication space S1. The swivel prevention plate 60 is joined to the upper surface of the bottom of the first frame 31*c*1 of the lower casing 31*c* and the inner surface of the peripheral wall, and extends radially from the peripheral wall of the first frame 31*c*1 to the central axis O. In addition, the swivel prevention plate 60 extends vertically above the extension line L1 passing through the center of the suction nozzle 36 from the upper surface of the bottom of the first frame 31*c*1. As an example, the swivel prevention plate 60 has a plate thickness of 3 mm and a size of 70 mm×75 mm.

According to the above-described configuration, the swirling vortex generated when the fluid flows from the suction nozzle 36 into the lower casing 31*c* and changes its flow path by 90 degrees can be divided by the swivel prevention plate 60 and rectified. By such rectification of the swirling vortex, the fluid loss is suppressed and the suction performance of the pump is improved as compared with the conventional configuration. In addition, by reducing the swirling vortex, wear and deterioration of the flow path portion of the pump can be suppressed, and the life of the pump can be improved.

Therefore, according to the vertical multi-stage pump 1 of the second embodiment described above, it is provided with the rotation shaft 2 extending in the vertical direction, the plurality of impellers 4 fixed to the rotation shaft 2, a multi-stage pump chamber 30A accommodating the plurality of impellers 4 and including the first suction port 8 for the first-stage impeller 4 at a lower end, a lower casing 31*c* including a suction nozzle 36 extending in a horizontal direction and forming a communication space S1 communicating the suction nozzle 36 and the suction port 8, and the swivel prevention plate 60 extending in the radial direction toward the central axis O of the rotation shaft 2 in the communication space S1. By employing such a configuration, deterioration of the suction performance of the pump can be suppressed.

Third Embodiment

Next, the third embodiment of the present invention will be described. In the following description, the same or equivalent configurations as those in the above-described embodiment are designated by the same reference numerals, and the description thereof will be simplified or omitted.

Figure 7:
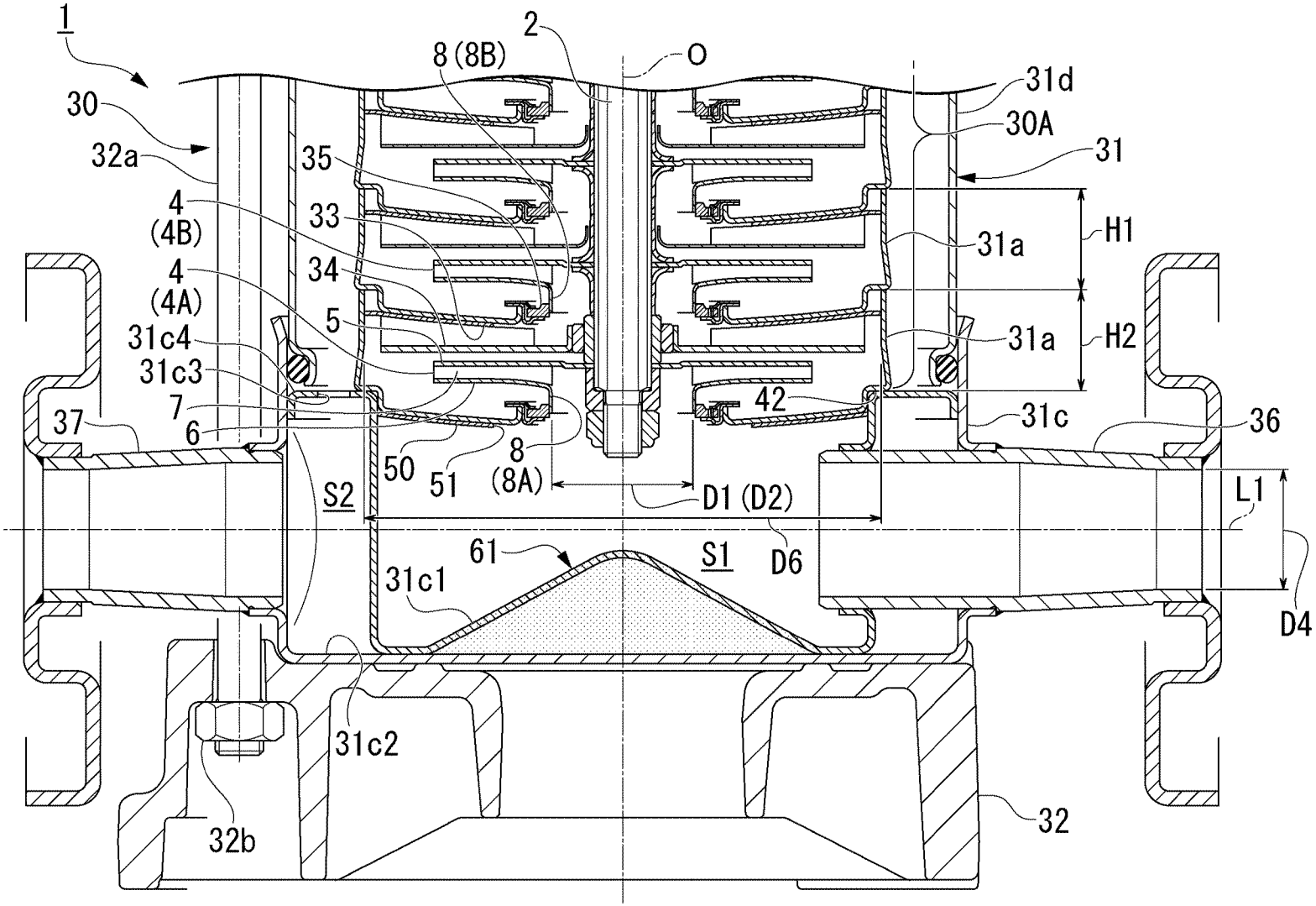
FIG. 7 is a cross-sectional view of the main configuration of the vertical multi-stage pump according to a third embodiment.

FIG. 7 is a cross-sectional view showing a configuration of a main portion of the vertical multi-stage pump 1 according to the third embodiment.

As shown in FIG. 7, the vertical multi-stage pump 1 of the third embodiment includes a raised portion 61 which is raised in a conical shape about the rotation shaft 2 on the bottom surface of the communication space S1.

As shown in FIG. 7, the raised portion 61 is formed in a conical shape coaxial with the central axis O, and is raised vertically upward from the bottom surface of the communication space S1. The raised portion 61 can be formed by press-molding the bottom portion of the first frame 31*c*1 of the lower casing 31*c* into a conical shape. The raised portion 61 may be formed by joining a conical plate to the upper surface of the bottom of the first frame 31*c*1. The raised portion 61 extends vertically upward from the upper surface of the bottom of the first frame 31*c*1 at a height of an extension line L1 or less passing through the center of the suction nozzle 36. As an example, the raised portion 61 includes a rounded tip of R20 and has a size of 34 mm×ϕ127 mm.

According to the above-described configuration, when the fluid flows from the suction nozzle 36 into the lower casing 31*c* and changes its flow path by 90 degrees, it flows along the conical raised portion 61, so that the generation of a swirling vortex can be suppressed. By suppressing the swirling vortex, fluid loss is suppressed and the suction performance of the pump is improved compared to the conventional configuration. In addition, by reducing the swirling vortex, wear and deterioration of the flow path portion of the pump can be suppressed, and the life of the pump can be improved.

Therefore, according to the vertical multi-stage pump 1 of the third embodiment described above, it is provided with the rotation shaft 2 extending in the vertical direction, the plurality of impellers 4 fixed to the rotation shaft 2, the multi-stage pump chamber 30A accommodating the plurality of impellers 4 and including the suction port 8 for the first-stage impeller 4 at a lower end, the lower casing 31*c* including the suction nozzle 36 extending in a horizontal direction and forming the communication space S1 communicating the suction nozzle 36 and the suction port 8, and the raised portion 61 having a conical raised portion centered on the rotation shaft 2 in the bottom surface of the communication space S1. By employing such a configuration, deterioration of the suction performance of the pump can be suppressed.

Fourth Embodiment

Next, the fourth embodiment of the present invention will be described. In the following description, the same or equivalent configurations as those in the above-described embodiment are designated by the same reference numerals, and the description thereof will be simplified or omitted.

Figure 8:
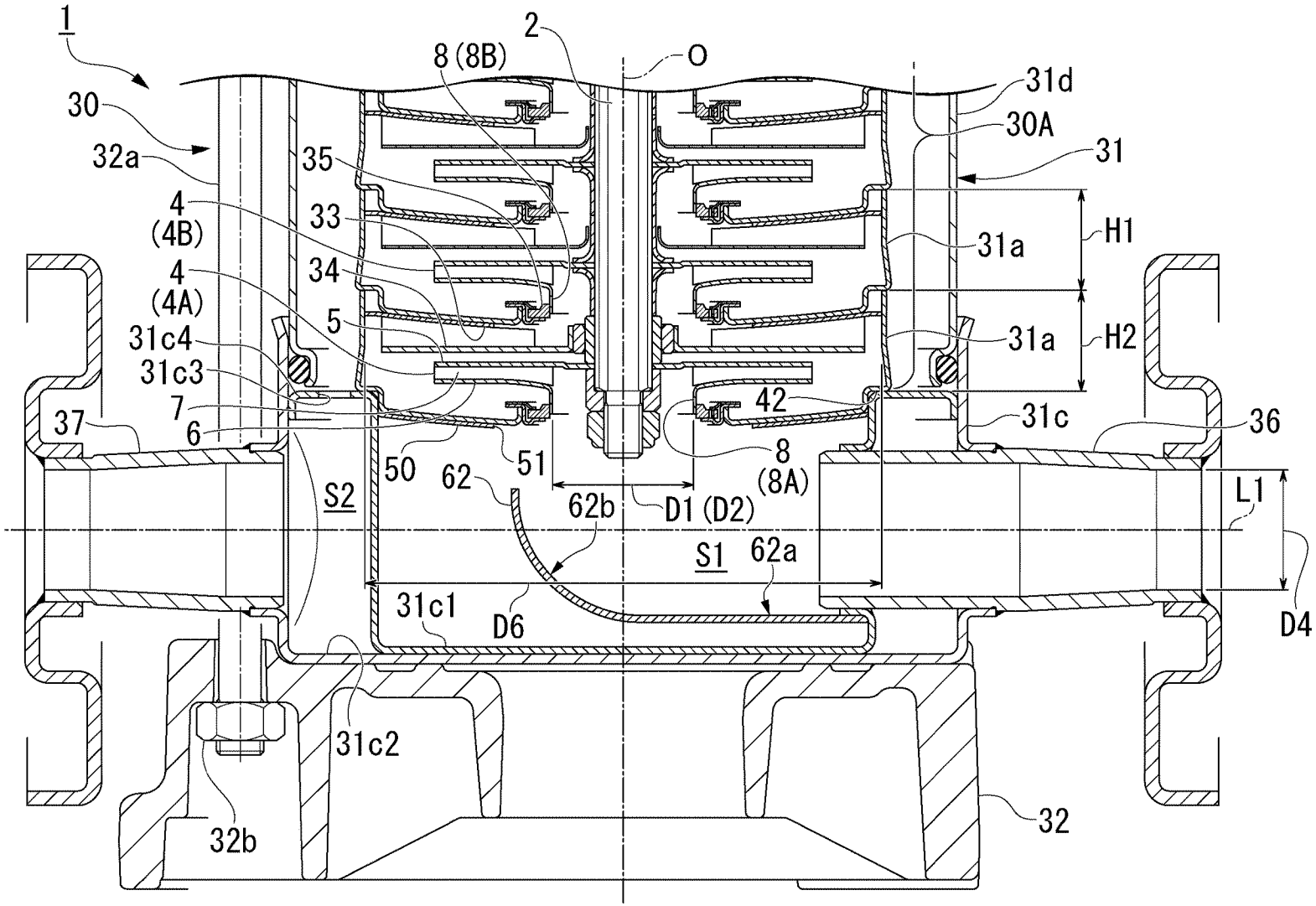
FIG. 8 is a cross-sectional view of the main configuration of the vertical multi-stage pump according to a fourth embodiment.
Figure 9:
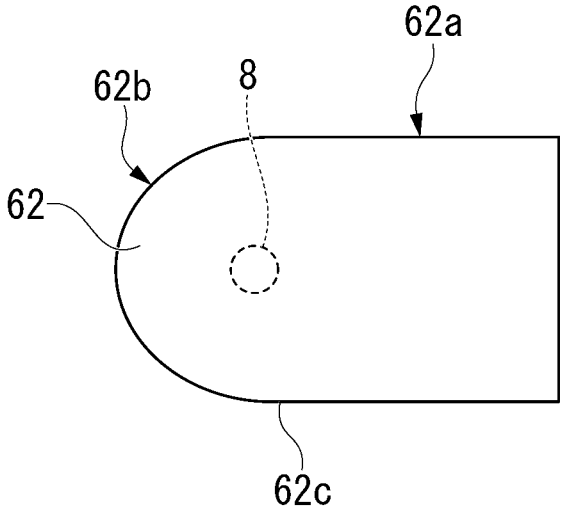
FIG. 9 is a plan view of a guide portion included in the vertical multi-stage pump according to a fourth embodiment.

FIG. 8 is a cross-sectional view showing a main portion configuration of the vertical multi-stage pump 1 according to the fourth embodiment. FIG. 9 is a plan view of a guide portion 62 included in the vertical multi-stage pump 1 according to the fourth embodiment.

As shown in FIG. 8, the vertical multi-stage pump 1 of the fourth embodiment is arranged on the extension line L1 of the suction nozzle 36 in the communication space S1, and the guide portion 62 curved from the horizontal direction upward in the vertical direction, which are different from the above-described embodiment.

As shown in FIG. 8, the guide portion 62 includes a horizontal portion 62*a* extending in the horizontal direction from below the suction nozzle 36 in the communication space S1 and a curved portion 62*b* curved upward in the vertical direction from the horizontal portion 62*a*. The horizontal portion 62*a* extends radially from below the suction nozzle 36 to the central axis O. In addition, the curved portion 62*b* extends from the tip end (central axis O) of the horizontal portion 62*a* to the outside in the radial direction from the opening edge on the opposite side of the suction nozzle 36 of the suction port 8 of the impeller 4.

As shown in FIG. 9, the guide portion 62 has a tongue shape with a rounded tip in plan view. The portion of the tongue shape having a constant width is the above-mentioned horizontal portion 62*a*. In addition, the semicircular portion in the tongue shape is the above-mentioned curved portion 62*b*. The portion of the guide portion 62 other than the outer peripheral edge 62*c* may be recessed and may be dish-shaped or spoon-shaped. As a result, the fluid that has collided with the guide portion 52 can be collected toward the suction port 8 of the impeller 4. As an example, the guide portion 62 has a size of 84 mm×33 mm and a height of 70 mm in plan view with respect to the inlet diameter D4 (pump diameter: 32 mm) of the suction nozzle 36.

According to the above-described configuration, the flow from the suction nozzle 36 to the suction port 8 of the impeller 4 changes by substantially 90 degrees from the horizontal direction to the vertical direction, so that turbulence occurs. However, as shown in FIG. 8, since the guide portion 62 is arranged on the extension line L1 of the suction nozzle 36, the change in the angle of the fluid becomes gentle, and the occurrence of turbulent flow can be reduced. By suppressing the turbulent flow flowing into the suction port 8 of the impeller 4, the suction efficiency is increased. In addition, the present shape of the guide portion 62 is a size for optimizing the above-described effect, and the generation of turbulent flow can be minimized, and the suction efficiency of the pump is improved.

Therefore, according to the vertical multi-stage pump 1 of the fourth embodiment described above, it is provided with the rotation shaft 2 extending in the vertical direction, the plurality of impellers 4 fixed to the rotation shaft 2, the multi-stage pump chamber 30A accommodating the plurality of impellers 4 and including the suction port 8 for the first-stage impeller 4 at a lower end, the lower casing 31*c* including the suction nozzle 36 extending in a horizontal direction and forming a communication space S1 communicating the suction nozzle 36 and the suction port 8, and the guide portion 62 arranged on an extension line S1 of the suction nozzle 36 and curved from a horizontal direction to an upward direction in a vertical direction in the communication space S1. By employing such a configuration, a decrease in suction performance can be suppressed.

In the above-mentioned fourth embodiment, the modification example shown in FIG. 10 below can be employed.

Figure 10:
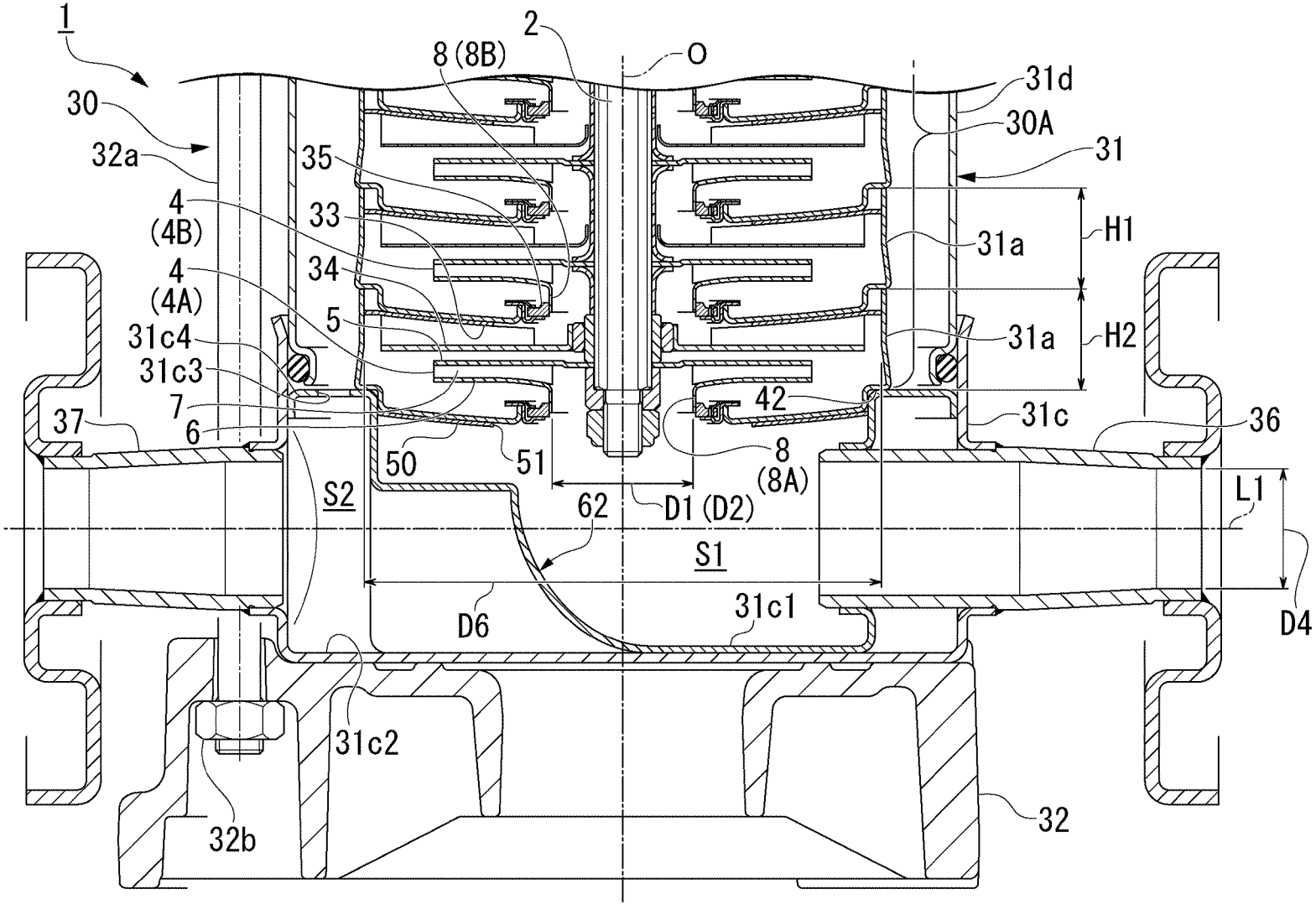
FIG. 10 is a cross-sectional view of the main configuration of the vertical multi-stage pump according to a modification example of a fourth embodiment.

FIG. 10 is a cross-sectional view showing a configuration of a main portion of the vertical multi-stage pump 1 according to a modification example of the fourth embodiment.

In the vertical multi-stage pump 1 shown in FIG. 10, the guide portion 62 described above is integrally formed by press-molding the bottom portion of the first frame 31*c*1 instead of joining the lower casing 31*c* to the first frame 31*c*1. According to such a configuration, since the first frame 31*c*1 and the guide portion 62 need only be one component, the number of components can be reduced and the assemblability can be improved.

Fifth Embodiment

Next, the fifth embodiment of the present invention will be described. In the following description, the same or equivalent configurations as those in the above-described embodiment are designated by the same reference numerals, and the description thereof will be simplified or omitted.

Figure 11:
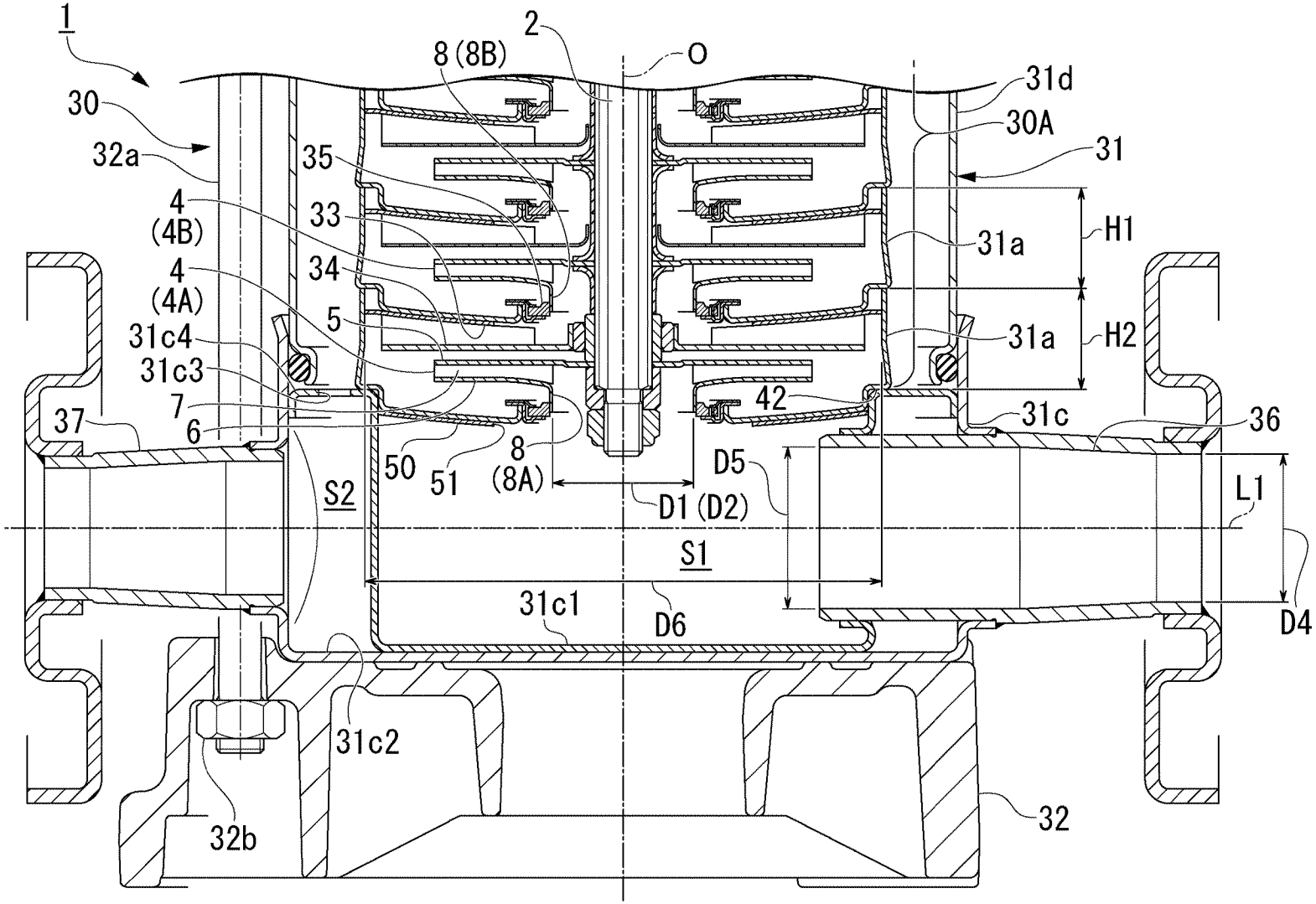
FIG. 11 is a cross-sectional view of the main configuration of the vertical multi-stage pump according to a fifth embodiment.

FIG. 11 is a cross-sectional view showing a configuration of a main portion of the vertical multi-stage pump 1 according to the fifth embodiment.

As shown in FIG. 11, the vertical multi-stage pump 1 of the fifth embodiment is different from the above-described embodiment in that the suction nozzle 36 has an enlarged diameter.

As shown in FIG. 11, the inlet diameter D4 of the suction nozzle 36 is larger than the inlet diameter D4 (suction port diameter of a standard product) of the suction nozzle 36 of the above-described embodiment. As an example, the inlet diameter D4 of the suction nozzle 36 has a size of 1 to 1.2 times the inlet diameter D4 of the above-mentioned standard. The outlet diameter D5 of the suction nozzle 36 has a size of 1.1 to 1.3 times that of the inlet diameter D4 of the suction nozzle 36.

According to the above-described configuration, by expanding the diameter of the suction nozzle 36, the fluid loss when the fluid flows from the suction nozzle 36 into the lower casing 31*c* can be suppressed, and the generation of a swirling vortex can also be suppressed. By suppressing the swirling vortex, fluid loss is suppressed and the suction performance of the pump is improved compared to the conventional configuration. In addition, by reducing the swirling vortex, wear and deterioration of the flow path portion of the pump can be suppressed, and the life of the pump can be improved.

Therefore, according to the vertical multi-stage pump 1 of the seventh embodiment described above, it is provided with the rotation shaft 2 extending in the vertical direction, the plurality of impellers 4 fixed to the rotation shaft 2, the multi-stage pump chamber 30A accommodating the plurality of impellers 4 and including the first suction port 8 for the first-stage impeller 4 at a lower end, and the lower casing 31*c* including the suction nozzle 36 extending in a horizontal direction and forming a communication space S1 communicating the suction nozzle 36 and the suction port 8, and an outlet diameter D5 of the suction nozzle 36 is larger than an inlet diameter D4 of the suction nozzle 36. By employing such a configuration, deterioration of the suction performance of the pump can be suppressed.

Sixth Embodiment

Next, the sixth embodiment of the present invention will be described. In the following description, the same or equivalent configurations as those in the above-described embodiment are designated by the same reference numerals, and the description thereof will be simplified or omitted.

Figure 12:
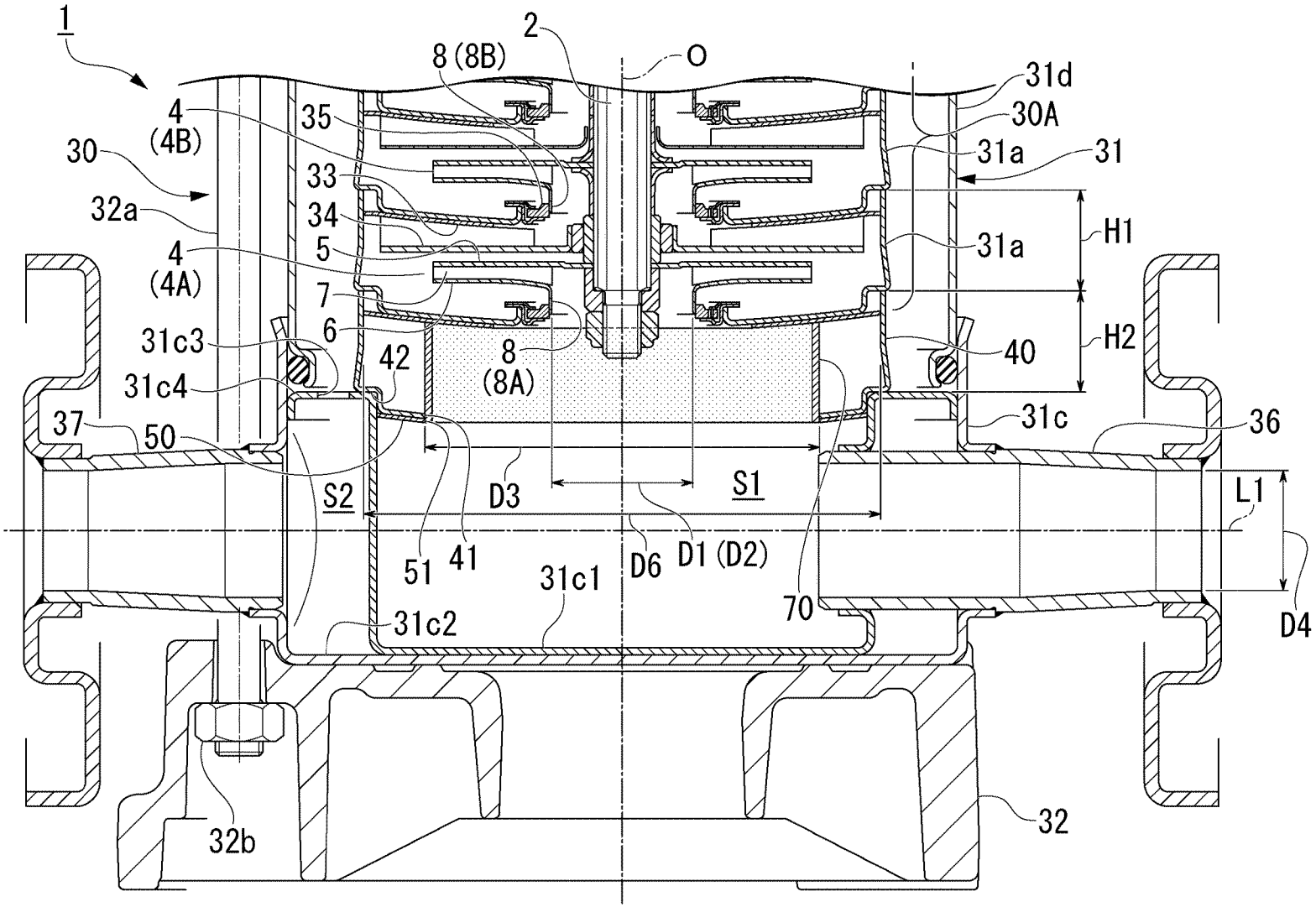
FIG. 12 is a cross-sectional view of the main configuration of the vertical multi-stage pump according to a sixth embodiment.

FIG. 12 is a cross-sectional view showing a main portion configuration of the vertical multi-stage pump 1 according to the sixth embodiment.

As shown in FIG. 12, the vertical multi-stage pump 1 of the sixth embodiment includes a cylindrical guide 70 extending in the vertical direction from the lower end opening 41 of the inner cylinder member 40 to the suction port 8 described above, which are different from the above-described embodiment.

As shown in FIG. 12, the cylindrical guide 70 is formed in a cylindrical shape coaxial with the central axis O, and the outer periphery of the lower end thereof is joined to the lower end opening 41 (and the inner end edge 51 of the annular wall 50) of the inner cylinder member 40. The upper end of the cylindrical guide 70 extends to the same height as the suction port 8 of the impeller 4 and surrounds the suction port 8. The inner diameter of the cylindrical guide 70 has substantially the same size as the inner diameter D3 of the annular wall 50 described above. That is, the inner diameter of the cylindrical guide 70 has a size of 1.5 to 3 times that of the suction port diameter of a standard product (suction port 8 of the impeller 4) determined by the inlet diameter D4 of the suction nozzle 36 described above.

According to the above configuration, by providing the cylindrical guide 70, the inner wall surface forming the fluid flow path becomes smoother than the peripheral wall of the inner cylinder member 40. Thus, the fluid that flows from the suction nozzle 36 into the lower casing 31*c* to rectify the swirling vortex generated when the flow path is changed by 90 degrees can be rectified. By such rectification of the swirling vortex, the fluid loss is suppressed and the suction performance of the pump is improved as compared with the conventional configuration. In addition, by reducing the swirling vortex, wear and deterioration of the flow path portion of the pump can be suppressed, and the life of the pump can be improved.

Therefore, according to the vertical multi-stage pump 1 of the sixth embodiment described above, it is provided with the rotation shaft 2 extending in the vertical direction, the plurality of impellers 4 fixed to the rotation shaft 2, the multi-stage pump chamber 30A accommodating the plurality of impellers 4 and including the first suction port 8 for the first-stage impeller 4 at a lower end, the lower casing 31*c* including the suction nozzle 36 extending in a horizontal direction and forming a communication space S1 communicating the suction nozzle 36 and the suction port 8, the inner cylinder member 40 that is interposed between the multi-stage pump chamber 30A and the lower casing 31*c* and expands the communication space S1 in the vertical direction, and the cylindrical guide 70 extending in a vertical direction from the lower end opening 41 of the inner cylinder member 40 to the suction port 8. By employing such a configuration, deterioration of the suction performance of the pump can be suppressed.

In the sixth embodiment described above, the modified examples shown in FIGS. 13 to 15 below can be employed.

Figure 13:
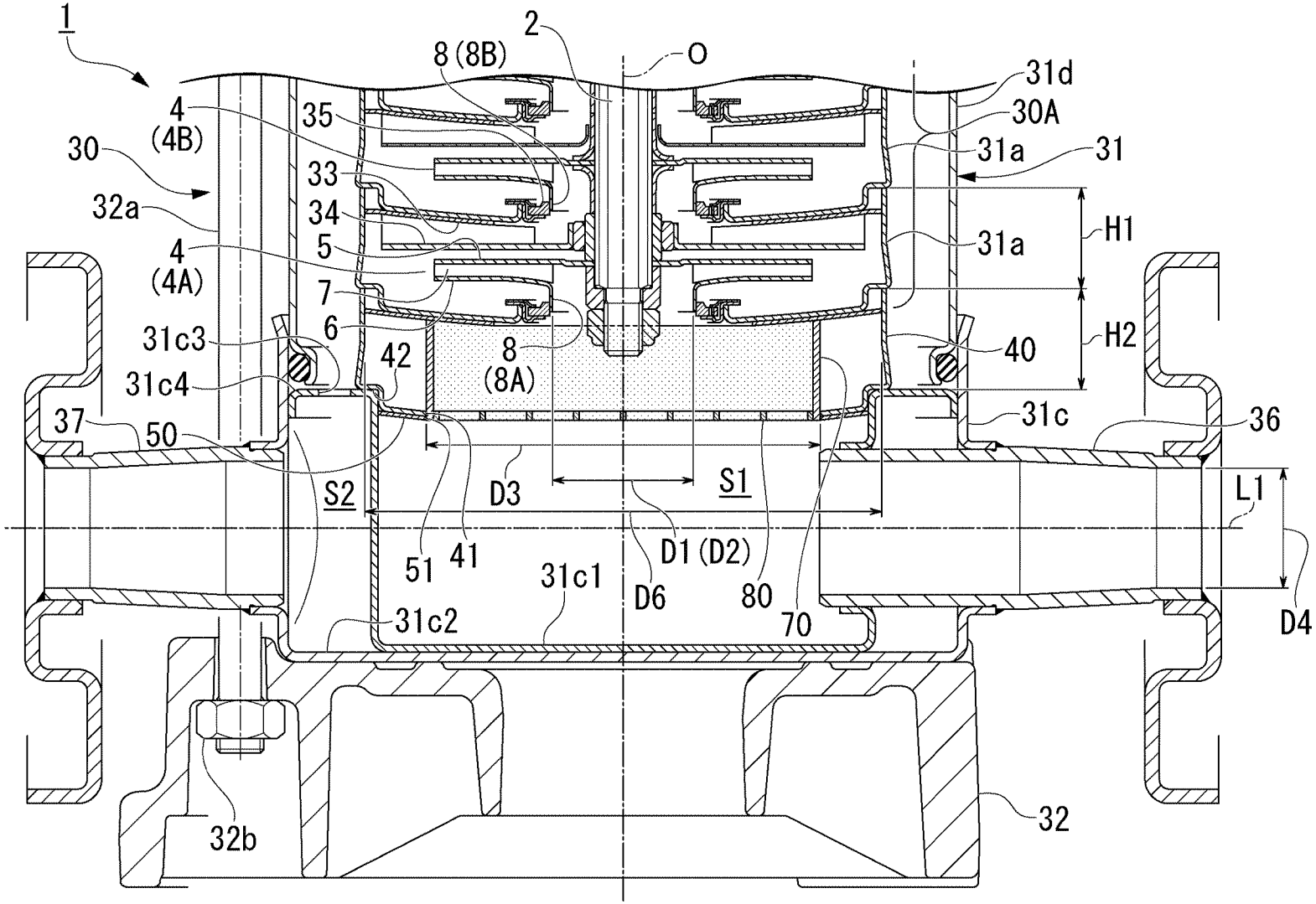
FIG. 13 is a cross-sectional view of the main configuration of the vertical multi-stage pump according to a modification example of a sixth embodiment.
Figure 14:
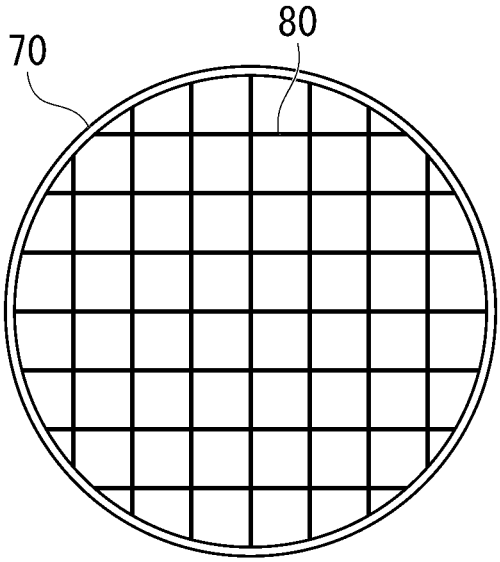
FIG. 14 is a bottom view of the cylindrical guide 70 included in the vertical multistage pump according to a modification example of a sixth embodiment.

FIG. 13 is a cross-sectional view showing a configuration of a main portion of the vertical multi-stage pump 1 according to a modification example of the sixth embodiment. FIG. 14 is a bottom view of the cylindrical guide 70 included in the vertical multi-stage pump 1 according to a modification example of the sixth embodiment.

The vertical multi-stage pump 1 shown in FIGS. 13 and 14 includes a rectification grid 80 provided inside the cylindrical guide 70.

As shown in FIG. 13, the rectification grid 80 is attached to the lower end opening of the cylindrical guide 70. The rectification grid 80 may be integrally formed by pressing (bottom punching) the cylindrical guide 70 (having a bottomed tubular shape). As shown in FIG. 14, the rectification grid 80 extends in the front-back and left-right directions in the horizontal direction, and forms a plurality of squares into which the fluid flows into the lower end opening of the cylindrical guide 70. According to such a configuration, the rectification effect of the above-mentioned cylindrical guide 70 can be further enhanced.

Figure 15:
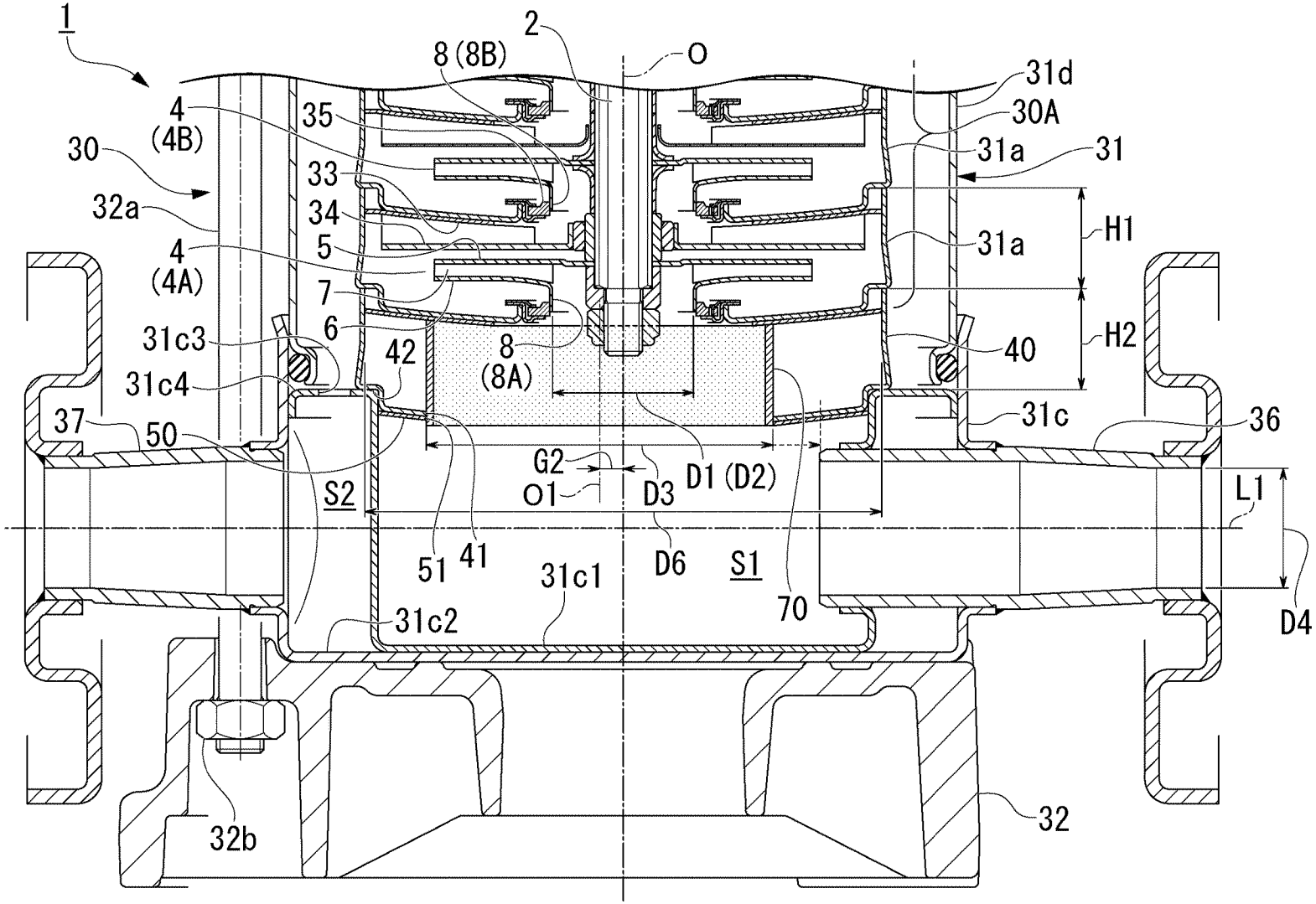
FIG. 15 is a cross-sectional view of the main configuration of the vertical multi-stage pump according to a modification example of a sixth embodiment.

FIG. 15 is a cross-sectional view showing a configuration of a main portion of the vertical multi-stage pump 1 according to a modification example of the sixth embodiment.

In the vertical multi-stage pump 1 shown in FIG. 15, the center O1 of the cylindrical guide 70 is eccentric with respect to the center (central axis O) of the suction port 8 of the impeller 4. The amount of eccentricity G2 in the horizontal direction of the center O1 of the cylindrical guide 70 with respect to the central axis O is preferably 0.1 mm to 40 mm as an example.

According to such a configuration, by shifting the center O1 of the cylindrical guide 70 so that the center (central axis O) of the suction port 8 of the impeller 4 does not match, uniform inflow of the swirling vortex to the cylindrical guide 70 is blocked (i.e., flow is disturbed) that is generated when the fluid flows from the suction nozzle 36 into the lower casing 31*c* and changes its flow path by substantially 90 degrees. Thus, the swirling vortex can be reduced. Due to the reduction of the swirling vortex, the fluid loss is suppressed and the suction performance of the pump is improved as compared with the conventional configuration.

Seventh Embodiment

Next, the seventh embodiment of the present invention will be described. In the following description, the same or equivalent configurations as those in the above-described embodiment are designated by the same reference numerals, and the description thereof will be simplified or omitted.

Figure 16:
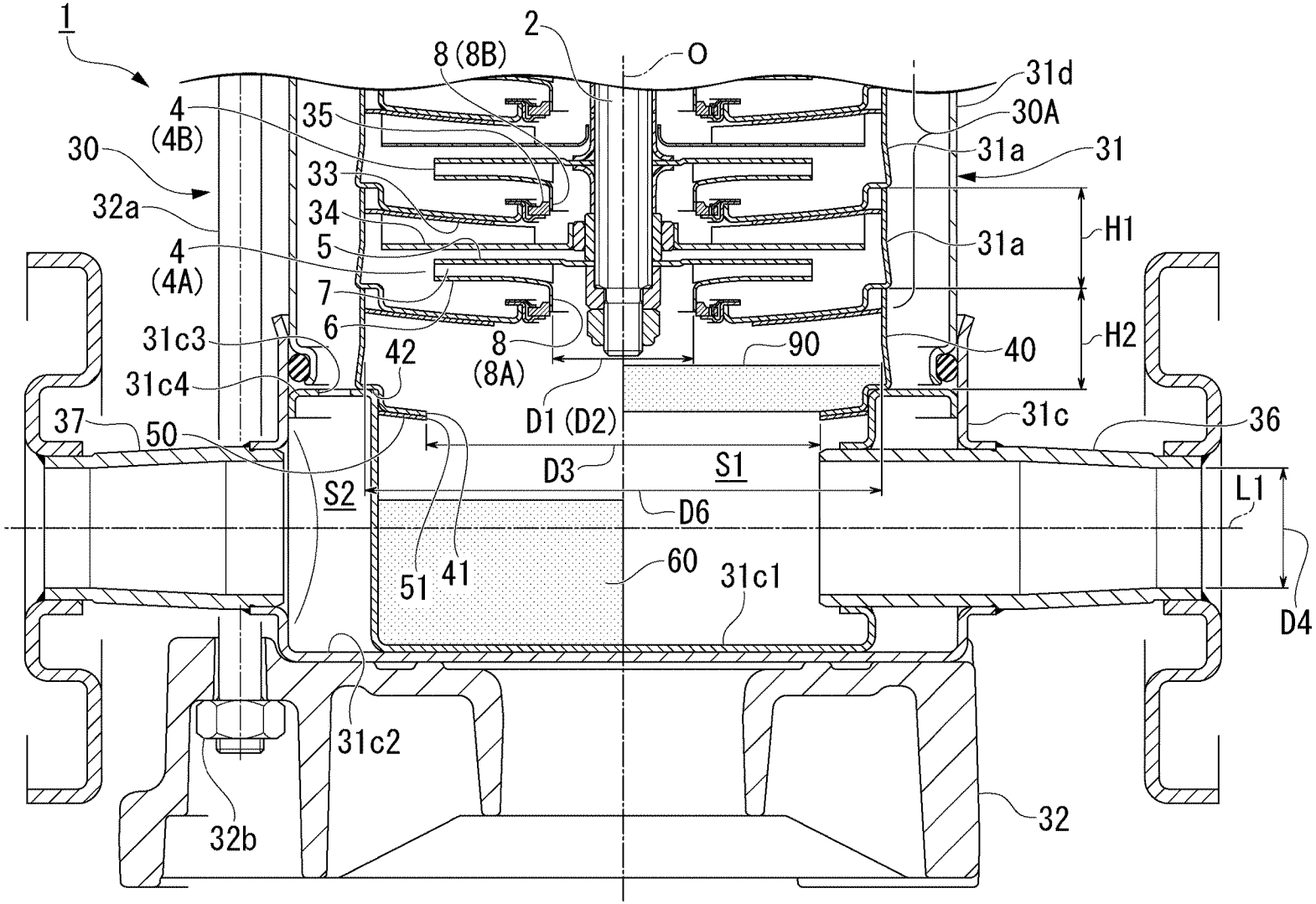
FIG. 16 is a cross-sectional view of the main configuration of the vertical multi-stage pump according to a seventh embodiment.

FIG. 16 is a cross-sectional view showing a configuration of a main portion of the vertical multi-stage pump 1 according to the seventh embodiment.

As shown in FIG. 16, the vertical multi-stage pump 1 of the seventh embodiment includes, in the communication space 51 of the lower casing 31*c*, the first swivel prevention plate 60 extending in a radial direction toward the central axis O of the rotation shaft 2 (swivel prevention plate 60 described above), and inside the inner cylinder member 40, and a second swivel prevention plate 90 extending in the radial direction toward the central axis O of the rotation shaft 2, which are different from the above embodiment.

As shown in FIG. 16, the first swivel prevention plate 60 and the second swivel prevention plate 90 are each formed in the shape of a rectangular plate. The first swivel prevention plate 60 is arranged on the side opposite to the suction nozzle 36 in the communication space 51 of the lower casing 31*c*. The second swivel prevention plate 90 is arranged on the suction nozzle 36 side inside the inner cylinder member 40. That is, the first swivel prevention plate 60 and the second swivel prevention plate 90 have a point-symmetrical positional relationship about the central axis O in plan view.

According to the above configuration, the swirling vortex generated when the fluid flows from the suction nozzle 36 into the lower casing 31*c* and changes its flow path by 90 degrees can be rectified by dividing in opposite directions to each other and in two steps by the first swivel prevention plate 60 and the second swivel prevention plate 90. By such rectification of the swirling vortex, the fluid loss is suppressed and the suction performance of the pump is improved as compared with the conventional configuration. In addition, by reducing the swirling vortex, wear and deterioration of the flow path portion of the pump can be suppressed, and the life of the pump can be improved.

Therefore, according to the vertical multi-stage pump 1 of the seventh embodiment described above, it is provided with the rotation shaft 2 extending in the vertical direction, the plurality of impellers 4 fixed to the rotation shaft 2, the multi-stage pump chamber 30A accommodating the plurality of impellers 4 and including the first suction port 8 for the first-stage impeller 4 at a lower end, the lower casing 31*c* including the suction nozzle 36 extending in a horizontal direction and forming a communication space S1 communicating the suction nozzle 36 and the suction port 8, the inner cylinder member 40 that is interposed between the multi-stage pump chamber 30A and the lower casing 31*c* and expands the communication space S1 in the vertical direction, the first swivel prevention plate 60 extending in the radial direction toward the central axis O of the rotation shaft 2 in the communication space S1 of the lower casing 31*c*, and the second swivel prevention plate 90 extending in the radial direction toward the central axis O of the rotation shaft 2 inside the inner cylinder member 40. By employing such a configuration, deterioration of the suction performance of the pump can be suppressed.

Although preferred embodiments of the present invention have been described above, it should be understood that these are exemplary and should not be considered as limiting. Additions, omissions, substitutions, and other modifications may be made without departing from the scope of the invention. Therefore, the present invention should not be considered limited by the above description, but is limited by the claims.

For example, the present invention can be applied not only to the above-mentioned vertical multi-stage pump 1 (vertical multi-stage line pump in which the suction nozzle 36 and the discharge nozzle 37 are provided on the same straight line), but also a vertical multi-stage pump (for example, a vertical multi-stage immersion pump) having a similar positional relationship of the suction nozzle 36, the communication space S1, and the suction port 8.

In addition, for example, the combination and substitution of each of the above-described embodiments and modifications can be appropriately performed.

INDUSTRIAL APPLICABILITY

The present invention relates to a vertical multi-stage pump and can suppress deterioration of the suction performance of the pump.

DESCRIPTION OF THE REFERENCE SYMBOLS

1: Vertical multi-stage pump, 2: Rotation shaft, 4: Impeller, 8: Suction port, 8A: First suction port, 8B: Second suction port, 30A: Multi-stage pump chamber, 31*c*: Lower casing, 36: Suction nozzle, 40: Inner cylinder member, 41: Lower end opening, 50: Annular wall, 51: Inner end edge, 60: Swivel prevention plate (first swivel prevention plate), 61: Raised portion, 62: Guide portion, 70: Cylindrical guide, 80: Rectification grid, 90: Second swivel prevention plate, D4: Inlet diameter, D5: Outlet diameter, L1: Extension line, S1: Communication space

What is claimed is:

1. A vertical multi-stage pump, comprising:

a rotation shaft extending in a vertical direction;

a plurality of impellers fixed to the rotation shaft;

a multi-stage pump chamber accommodating the plurality of impellers and comprising a suction port for a first-stage impeller at a lower end;

a lower casing comprising a suction nozzle extending in a horizontal direction and forming a communication space communicating the suction nozzle and the suction port;

an inner cylinder member interposed between the multi-stage pump chamber and the lower casing and expanding the communication space in a vertical direction; and an annular wall provided at a lower surface of a bottom of the inner cylinder member and protruding toward an inside of the inner cylinder member more than a peripheral wall of the inner cylinder member, wherein a lower surface of the multi-stage pump chamber near the suction port, a peripheral wall of the inner cylinder member, and the annular wall together form a space therein.

2. The vertical multi-stage pump according to claim 1, wherein a center of an inner edge of the annular wall is eccentric with respect to a center of the suction port.

3. The vertical multi-stage pump according to claim 1, further comprising a cylindrical guide extending in a vertical direction from a lower end opening of the inner cylinder member to the suction port.

4. The vertical multi-stage pump according to claim 3, comprising a rectification grid provided inside the cylindrical guide.

5. The vertical multi-stage pump according to claim 3, wherein a center of the cylindrical guide is eccentric with respect to a center of the suction port.

6. The vertical multi-stage pump according to claim 3, comprising:

in the communication space of the lower casing, a first swivel prevention plate extending in a radial direction toward a central axis of the rotation shaft; and inside the inner cylinder member, a second swivel prevention plate extending in the radial direction toward the central axis of the rotation shaft.

7. A vertical multi-stage pump, comprising:

a rotation shaft extending in a vertical direction;

a plurality of impellers fixed to the rotation shaft;

a multi-stage pump chamber accommodating the plurality of impellers and comprising a first suction port for a first-stage impeller at a lower end; and a lower casing comprising a suction nozzle extending in a horizontal direction and forming a communication space communicating the suction nozzle and the first suction port, wherein the first suction port has a port diameter which is greater than an inlet diameter of the suction nozzle, the first suction port is formed larger than a second suction port of a second, or subsequent, stage impellers, and the second suction ports of the second, or subsequent, stage impellers have constant size.

8. The vertical multi-stage pump according to claim 7, comprising a swivel prevention plate extending radially toward a central axis of the rotating shaft in the communicating space.

9. The vertical multi-stage pump according to claim 7, comprising a raised portion, which is in a conical shape, is coaxial with a central axis, and is raised vertically upward from a bottom surface of the communication space.

10. The vertical multi-stage pump according to claim 7, comprising a guide portion arranged on an extension line of the suction nozzle and curved from a horizontal direction to an upward direction in a vertical direction in the communication space.

11. The vertical multi-stage pump according to claim 7, wherein an outlet diameter of the suction nozzle is larger than an inlet diameter of the suction nozzle.

* * * * *